US011512467B2

(12) United States Patent
Mussati et al.

(10) Patent No.: US 11,512,467 B2
(45) Date of Patent: Nov. 29, 2022

(54) CEILING MODULE FOR THE CONSTRUCTION OF A CLEAN ROOM

(71) Applicant: Exyte Management GmbH, Stuttgart (DE)

(72) Inventors: Luca Mussati, Cologne (DE); Martin Gerhard Wenz, Bietigheim-Bissingen (DE); Stefan Kappeler, Therwil (CH); Stephan Hofheinz, Gerlingen (DE); Sebastian Ellinger, Reutlingen (DE); Igor Rod, Wayland, MA (US)

(73) Assignee: Exyte Management GmbH, Stuttgart (DE)

( * ) Notice: Subject to any disclaimer, the term of this patent is extended or adjusted under 35 U.S.C. 154(b) by 731 days.

(21) Appl. No.: 16/512,451

(22) Filed: Jul. 16, 2019

(65) Prior Publication Data

US 2021/0017763 A1 Jan. 21, 2021

(51) Int. Cl.

| | |
|---|---|
| ***E04B 9/02*** | (2006.01) |
| ***F24F 3/167*** | (2021.01) |
| ***E04B 9/06*** | (2006.01) |
| ***E04H 5/02*** | (2006.01) |

(52) U.S. Cl.

CPC ..... *E04B 9/02* (2013.01); *E04B 9/06* (2013.01); *E04H 5/02* (2013.01); *F24F 3/167* (2021.01); *F24F 2221/14* (2013.01)

(58) Field of Classification Search

CPC ..... E04B 9/02; E04B 9/06; E04H 5/02; F24F 3/167; F24F 2221/14; F24F 2221/17

See application file for complete search history.

(56) References Cited

U.S. PATENT DOCUMENTS

| | | | | | |
|---|---|---|---|---|---|
| 4,232,594 | A | * | 11/1980 | Kuhr | E04B 9/0435 454/301 |
| 4,267,769 | A | | 5/1981 | Enviromental | |
| 4,409,889 | A | | 10/1983 | Burleson | |
| 4,554,766 | A | * | 11/1985 | Ziemer | E04B 9/02 52/28 |
| 4,667,579 | A | * | 5/1987 | Daw | B01L 1/04 52/509 |
| 4,860,420 | A | * | 8/1989 | Cadwell, Jr. | E04B 9/064 55/483 |
| 5,029,518 | A | | 7/1991 | Austin | |

(Continued)

FOREIGN PATENT DOCUMENTS

| | | | |
|---|---|---|---|
| CN | 102667023 | A | 9/2012 |
| CN | 104141998 | A | 11/2014 |

(Continued)

OTHER PUBLICATIONS

Second office action of Appl No. 202010675605.0 and translation; dated Dec. 28, 2021.*

*Primary Examiner* — Beth A Stephan

(74) *Attorney, Agent, or Firm* — Aslan Law, P.C.

(57) ABSTRACT

A ceiling module for the construction of a clean room cell, where the ceiling module includes at least a module support for arrangement on and connection to a support structure, a technical device including at least one filter unit, and a ceiling support which is spaced apart from the module support such that a technical space is formed between the ceiling support and the module support, wherein the technical device is arranged inside the technical space.

17 Claims, 10 Drawing Sheets

(56) References Cited

U.S. PATENT DOCUMENTS

| | | | | | |
|---|---|---|---|---|---|
| 5,090,163 | A * | 2/1992 | New | E04B 9/006 | 52/39 |
| 5,141,473 | A * | 8/1992 | Swaney | F24F 13/072 | 454/301 |
| 5,207,035 | A * | 5/1993 | Fowler | E04B 9/00 | 52/22 |
| 5,256,105 | A | 10/1993 | Clean | | |
| 6,267,793 | B1 * | 7/2001 | Gomez | B01D 46/42 | 55/504 |
| 6,514,137 | B1 | 2/2003 | Panelli et al. | | |
| 9,163,639 | B2 * | 10/2015 | Risser | F24F 13/04 | |
| 10,371,411 | B2 * | 8/2019 | Cursetjee | E04B 9/0478 | |
| 2003/0233797 | A1 * | 12/2003 | Anderson | E04B 9/02 | 52/220.5 |
| 2012/0077429 | A1 | 3/2012 | Wernimont et al. | | |
| 2012/0080347 | A1 * | 4/2012 | Rose | B65D 19/06 | 206/454 |
| 2013/0224043 | A1 * | 8/2013 | Risser | E04B 1/7076 | 415/206 |
| 2019/0292315 | A1 * | 9/2019 | Niemiec | C08G 81/00 | |
| 2020/0248449 | A1 * | 8/2020 | Hodsden | E04F 17/04 | |
| 2022/0011007 | A1 * | 1/2022 | Jespersen | E04B 9/008 | |

FOREIGN PATENT DOCUMENTS

| | | | | |
|---|---|---|---|---|
| CN | 205652546 | U | | 10/2016 |
| CN | 207299232 | U | * | 5/2018 |
| DE | 33 30 536 | A1 | | 3/1985 |
| DE | 10 2005 062 523 | A1 | | 6/2007 |
| DE | 10 2009 024232 | A1 | | 12/2010 |
| JP | H07 239093 | A | | 9/1995 |
| KR | 2019 0015798 | A | | 2/2019 |

* cited by examiner

CEILING MODULE FOR THE CONSTRUCTION OF A CLEAN ROOM

The invention relates to a ceiling module for constructing a clean room, and to systems comprising such a ceiling module.

Clean rooms are used in a variety of applications, for example, in semiconductor manufacturing or in the production of pharmaceutical products, and are usually constructed from several basic components: an outer frame structure (e.g. a steel skeleton or a building wall); a plurality of airtight and particle-tight clean room walls which delimit the actual working region of the clean room, the so-called clean room plenum; and clean room technology for air filtration and possibly air circulation in the clean room plenum. The clean room technology is usually arranged above a clean room ceiling suspended from the outer frame structure and typically includes filter elements, HVAC units (heating, ventilating and air conditioning units), fluid lines, etc.

The construction of clean rooms, in particular of complexly designed clean room facilities, is time-consuming since the individual components have to be individually adapted to the specific requirements and then assembled at an intended location to form an airtight and particle-tight clean room. In particular, the construction of the clean room ceiling and the installation of clean room technology above the ceiling requires relatively high installation costs.

Container-like clean room modules are known which are provided as prefabricated, self-contained units which then simply have to be connected to appropriate supply lines at a location. US2012/0077429A1 discloses, for example, a mobile clean room module in which a sea container forms an outer frame structure of the clean room module. A clean room plenum is formed inside the container and the required clean room technology is arranged on the roof of the container. Such systems are quickly operational, but limited in their design options. Furthermore, due to the size, transport of such prefabricated clean room modules is complicated.

It is also known to provide prefabricated clean room wall elements which can then be combined with corresponding ceiling parts to form a clean room at an intended location. U.S. Pat. No. 5,029,518, for example, discloses a modular system in which prefabricated profile elements can be assembled as required to form clean room side walls. In this case, a ceiling structure is formed from a plurality of ceiling supports and a clean room ceiling suspended from the ceiling supports. A ceiling plenum formed between the ceiling supports and the clean room ceiling serves as an air plenum for drawing in exhaust air through an HVAC unit. This makes it necessary to seal the entire ceiling plenum in an airtight manner during installation. The HVAC unit is connected to filter elements arranged in the clean room ceiling via an air supply means. Such a configuration in principle makes a modular construction of a clean room possible. However, installation of the ceiling structure with a suspended ceiling and an airtight ceiling plenum, as well as installation of the air supply means, has also proven to be complicated.

The problem addressed by the present invention is that of simplifying the construction of a clean room. In particular, the aim is for it to be possible to construct complex, individually designed clean rooms in a simple and cost-effective manner.

This problem is solved by a ceiling module having the features of claim 1. The ceiling module is used to construct a clean room, in particular to construct a clean room cell, which in turn can be part of a larger clean room having a plurality of cells. The ceiling module comprises a module support for arrangement on and connection to a support structure, in particular of the building. The support structure can be, for example, pillars arranged on a foundation or supports fastened to a housing wall.

The ceiling module further comprises a technical device, which can in principle comprise essential components of the clean room technology. In particular, the technical device comprises at least one filter unit. The filter unit preferably comprises at least one filter means for filtering air and an air conveying means or fan means for generating an airflow, in particular an airflow through the at least one filter means. Filter units designed in this manner are also referred to as filter-ventilation units and are known from the prior art, for example from DE 10 2005 062 523 A1. However, it is also conceivable for the filter unit to be designed as a pure filtration means and, in this respect, to not comprise its own air conveying means. The filter means is designed in particular for filtering out particulate contaminants (dust).

The ceiling module further comprises a ceiling support which is spaced apart from the module support such that a technical space is formed between the ceiling support and the module support. In this case, the module support, the ceiling support and the technical device are connected to form a preassembled unit and thus form a module. The technical device is arranged inside the technical space. In this respect, the technical device—comprising the at least one filter unit—is arranged between the module support and the ceiling support.

When the ceiling module is mounted as intended on the support structure (installed state), the ceiling support is arranged below the module support and is spaced apart from the underside of the module support. The ceiling support is preferably suspended from the module support via support anchors (e.g. in the form of threaded rods or suspension cables). In particular, ceiling supports and module supports are structures which extend in a planar manner in one plane. The plane spanned by the ceiling support is preferably parallel to the plane spanned by the module support. In particular, ceiling supports and module supports are frame structures.

The ceiling support, in the installed state of the ceiling module, forms the framework for a clean room ceiling, and is thus part of a structure defining the actual clean room plenum. In particular, the ceiling support can be connected in the installed state to clean room side wall elements which laterally delimit the clean room plenum.

The at least one filter unit is used to supply the clean room plenum with filtered air. Preferably, the at least one filter unit, in an installed state of the ceiling module, can be coupled to an HVAC unit. It is possible for the at least one filter unit to be designed as an air circulation unit, i.e. it can both supply fresh air (filtered) to the clean room plenum, and can also recirculate exhaust air from the clean room plenum. In this respect, designs are conceivable in which exhaust air recirculation, for example via a floor-side air outlet, does not have to take place. If the filter unit is formed without its own air conveying means, then there is preferably floor-side exhaust air recirculation.

With a ceiling module according to the invention, therefore, essential elements of a clean room—clean room ceiling and clean room technology—which typically make installation particularly complex, are combined into one unit and provided in a modular manner. As a result, installation of a clean room cell is simplified considerably. For instance, the ceiling module comprising the at least one filter unit already comprises essential parts of the filter and air technology required for clean room operation, and therefore on-site installation of filter elements or air ducts is no longer required. In addition, time-consuming suspension of a clean room ceiling from an outer frame structure can be omitted. The ceiling module itself is also relatively easy to install. For instance, the ceiling module need only to be connected to the support structure, in particular placed on corresponding bearing portions of the support structure, and the at least one filter unit is connected.

A ceiling module according to the invention can be transported as a preassembled unit by conventional means of transport, e.g. a truck, which facilitates transport of the ceiling module to a destination. For this purpose, it is particularly preferred for the ceiling module to be dimensioned such that it does not exceed the dimensions of a 40-foot ISO container—i.e. an ISO container with a length of 40 feet, a width of 8 feet and a height of 8 feet and 6 inches. This allows the ceiling module to be transported in such a 40-foot ISO container, or it can even be assembled into a container structure, in particular by means of an associated transport frame (see below).

A ceiling module according to the invention also makes it possible to modularly construct complex clean room facilities consisting of a plurality of clean room cells arranged beside and/or behind one another, in a simple and cost-effective manner. It is conceivable, for example, to arrange a plurality of ceiling modules beside one another and to construct individualized clean room structures on account of different configurations and arrangements of clean room side wall elements.

In a preferred embodiment, the filter unit is designed as a modular unit with its own module housing, the module housing being completely accommodated in the technical space between the module support and the ceiling support. A flow connection between the fan means and filter means is then formed within the module housing. In this respect, it is not necessary to maintain an airtight plenum between a fan means and a filter means. In particular, it is therefore not absolutely necessary to design the technical space to be largely airtight.

Preferably, the at least one filter unit—when the ceiling module is mounted on the support structure as intended—is held by the ceiling support and is in particular mounted there. It is conceivable for the at least one filter unit to rest on a bearing surface on the upper side of the ceiling support.

In order to further simplify the construction of a clean room or clean room cell, it is further preferred for the technical device to comprise at least one fluid line having at least one air connection, the at least one fluid line being designed in particular to supply air to the at least one filter unit or to recirculate air therefrom. In particular, the at least one air connection is formed with a connecting piece for connecting to air lines, for example for a supply line of an HVAC unit. The connecting piece is preferably a standard connection, which further simplifies installation. In embodiments of the ceiling module with a plurality of filter units, the at least one fluid line may be formed as a distribution line.

It is further preferred for the technical device to also comprise at least one fluidic supply line having at least one fluid connection. Preferably, two fluidic supply lines for cooling water (feed-in line/return line) are provided. Optionally, a supply air and/or exhaust air line may also be provided for devices arranged in the clean room plenum. The at least one fluid connection is in particular provided with a connecting piece for connecting to fluid lines, for example an external cooling water supply. Preferably, the connecting piece is likewise a standard connection.

Furthermore, it is preferred for the technical device to also comprise at least one electrical supply line having at least one cable connection. In particular, an electrical supply line is provided for supplying power to the at least one filter unit and/or for supplying power to devices arranged in the clean room plenum. Furthermore, an electrical supply line can comprise bus lines, network cables and/or data transmission cables in general for data transmission between the at least one filter unit and/or between devices arranged in the clean room plenum and an external computer device, for example a network server.

The at least one electrical supply line is preferably arranged in one or more cable ducts. In particular, the cable connection is a junction box or a connection box in which power connections of the at least one filter unit and devices in the clean room plenum converge. There can then easily be a power connection via a main connection, which further facilitates the installation.

For a simple installation, it is further preferred for the at least one air connection, the at least one fluid connection and the at least one cable connection to be arranged such that the relevant connection is accessible from an upper side of the ceiling module. In this respect, there can also be a connection of the technical device as soon as the ceiling module is connected to the support structure and/or is arranged beside other ceiling modules. This simplifies the construction of extended clean room facilities.

In a preferred embodiment, the ceiling support is designed as a space frame which delimits a plurality of frame openings. In this respect, the ceiling support comprises a plurality of frame portions, each of which surrounds around a frame opening. The ceiling support thus forms a grid.

The frame openings are each used to accommodate a filter unit or a clean room ceiling panel. A clean room ceiling panel is an airtight and particle-tight planar element, e.g. sheet metal.

Depending on the requirements, the frame openings can then be occupied by filter units or clean room ceiling panels, which allows a flexible, needs-based construction of a clean room cell. It is possible for each frame opening to be occupied by a filter unit. It is also conceivable, however, for only a subset of the frame openings to be occupied by filter units and for the remaining frame openings to be occupied by clean room ceiling panels. In particular, a plurality of filter units are provided which are preferably mutually spaced by at least one clean room ceiling panel. As a result, sections can be defined in the clean room plenum delimited below the ceiling module, which sections are then supplied with air as required by means of a filter unit.

The ceiling support, together with the clean room ceiling panels and the filter units, in particular together with an air outlet of each of the filter units, forms the clean room ceiling. Preferably, the air outlet of the at least one filter unit and the clean room ceiling panel is flush with an underside of the ceiling support. In particular, a relevant filter unit and/or a relevant clean room ceiling panel are connected to the ceiling support in an airtight and particle-tight (dust-proof) manner.

In an advantageous embodiment, the ceiling support is formed by mutually perpendicular frame rails. Rectangular frame openings are provided as a result. In particular, outer frame rails are provided which define a periphery of the ceiling support and inner frame rails are provided which are perpendicular to a longitudinal extent of the ceiling support.

In principle, it is possible for the ceiling support to be monolithic. However, it is preferred for the frame rails to be provided separately from one other and, for preassembly of the module, to be connected to one another at corresponding node points by means of connecting elements. Such an embodiment allows a flexible, simple construction of the ceiling support. For example, it is possible to adapt the frame openings to the dimensions of different filter units. In particular, the frame rails are designed as profile rails, preferably made from an extruded aluminum profile. A ceiling support of this kind is then comparatively lightweight and yet stable.

For a simple construction of a clean room or clean room cell, it is further preferred for the ceiling support to have connecting portions which are designed for (in particular airtight and particle-tight) connection of the ceiling support to clean room side wall elements and/or clean room partition wall elements. This makes it possible to connect clean room side wall elements and/or clean room partition wall elements to a preinstalled ceiling support in a simple manner.

In the installed state of the clean room side wall elements, the ceiling support and the clean room side wall elements define the clean room plenum. The clean room partition wall elements make it possible to subdivide a clean room plenum defined by the clean room side wall elements into sections, i.e. subregions, in order to meet different requirements for working regions in the clean room environment. For example, in this way it is conceivable to define separate working regions in a clean room cell for different process steps. Preferably, the connecting portions for the clean room partition wall elements are arranged such that the clean room partition wall elements are arranged orthogonally to a longitudinal extent of the ceiling module.

Preferably, the connecting portions are formed as connecting rails which are integrated in the frame rails of the ceiling support. In particular, the connecting portions for connecting the ceiling support to the clean room side wall elements are arranged on the outer frame rails, i.e. on those frame rails which define an outer periphery of the ceiling support. The connecting portions for connecting the ceiling support to clean room partition wall elements are preferably arranged on the inner frame rails.

In an advantageous embodiment, the module support is rectangular in shape, thus having a rectangular basic shape overall. For this purpose, the module support has, for example, two mutually parallel and mutually spaced longitudinal supports, and a plurality of transverse supports which connect the two longitudinal supports. For example, the length-to-width ratio of the module support is four to one, allowing the construction of a corridor-like clean room cell. In particular, the ceiling support is then also rectangular.

Preferably, the transverse supports are, as viewed in the longitudinal direction of the module support, mutually spaced, in particular at regular intervals. Free spaces are then formed between the transverse supports, and portions of the module support are thus open at the top. This allows easy accessibility to the technical space, which is advantageous for easy maintenance of the technical device. Furthermore, such an embodiment is advantageous for adequate ventilation of the filter units.

Preferably, the longitudinal supports and/or the transverse supports are formed as a double-T support. This allows high stability with comparatively low weight, and makes it possible to place the ceiling module on corresponding bearing portions of the support structure by means of the horizontally extending portions of the module support (flange of the double-T support).

For this purpose, it is preferred for each longitudinal support to have a central region and two end regions, the longitudinal support having a smaller thickness in the end regions than in the central region, i.e. a distance between the upper side and underside of the longitudinal support is smaller in the end regions than in the central region. The underside of the longitudinal support then forms abutment portions in the respective end regions for abutting the support structure. Of course, other embodiments are conceivable which are adapted e.g. to static requirements.

Irrespective of the above embodiments, other functions may be integrated or established in the ceiling module which are advantageous for the construction of a clean room. For example, the ceiling module may optionally include a fire protection means. For instance, the ceiling module can comprise a fire protection layer, in particular in the form of a planar element arranged in the technical space and consisting of fire-retardant material, which can be connected to a fire protection layer of a building-side support structure or a fire protection layer of a clean room side wall element in order to form a fire protection layer that encloses a clean room plenum. Optionally, the fire protection means may further comprise a smoke extraction unit.

The above problem is also solved by a system comprising a ceiling module as described above and a transport frame, the transport frame and the ceiling module being designed such that the ceiling module can be held in the transport frame for transport. In this respect, the transport frame forms a transport rack for the ceiling module. Overall, the system is an apparatus in the sense of an aggregate of a plurality of devices which are in particular connected to form an apparatus or are integrated in a higher-level apparatus.

The above-described advantages and embodiments of the ceiling module can also be used for the embodiment of the system.

It is particularly preferred for the transport frame to have abutment portions which are designed to abut the underside of the module support of the ceiling module in a transport state of the ceiling module and to abut the upper side of the module support of the ceiling module in an installed state of the ceiling module. In the transport state, the ceiling module is then supported on the transport frame by the underside of the module support. In this state, the ceiling module is held in the transport frame. In this respect, the transport frame forms a transport rack for the ceiling module. In the installed state of the ceiling module, the transport frame can then be supported on the upper side of the module support. In this state, the transport frame can then form a holder for further functional units, in particular for clean room technology (e.g. for HVAC units). A transport frame of this kind is thus not only used to transport the ceiling module, but can also have a further functional use after transport during construction of the clean room.

The system is preferably designed such that, in the transport state, at least two systems consisting of a ceiling module and an associated transport frame are stackable. This allows for space-saving transport of a plurality of ceiling modules, for example in order to construct a clean room facility consisting of a plurality of clean room cells. In particular, the ceiling module and the transport frame are dimensioned such that two stacked systems, each consisting of a ceiling module and a transport frame, do not exceed the dimensions of a 40-foot ISO container.

Preferably, the transport frame is substantially U-shaped in longitudinal section and has one long limb and two short limbs. In the transport state, the long limb extends at the bottom, in particular horizontally, and the two short limbs extend substantially vertically. The free ends of the short limbs form the abutment portions for abutting the module support of the ceiling module.

In the transport state, the ceiling module is then arranged such that the technical device is arranged in a transport space of the transport frame formed between the short limbs. In such an embodiment, the technical device is protected by the transport frame during transport. If, as explained above, the transport frame is arranged on the upper side of the module support in the installed state of the ceiling module, the transport space forms a distribution space for arranging distribution lines, for example for connecting lines for connecting adjacent ceiling modules.

The above problem is further solved by a system comprising a ceiling module as described above and at least one clean room side wall element that is or can be connected to the ceiling module, in particular to a ceiling support of the ceiling module. As already explained, the ceiling support and the at least one clean room side wall element form a structure which defines the clean room plenum of the clean room cell.

The at least one clean room side wall element may further comprise one or more of the functional units mentioned below.

For example, the at least one clean room side wall element may have a door for accessing the clean room plenum.

Alternatively or in addition, the at least one clean room side wall element may have at least one window. This makes it possible to illuminate the clean room plenum with daylight and to monitor the plenum processes taking place in the clean room from the outside.

Alternatively or in addition, the at least one clean room side wall element can have an integrated, i.e. arranged inside the at least one clean room side wall element (e.g. between two outer wall portions), fluid duct for exhaust air and/or at least one integrated cable duct for electrical cables, such that no additional ducts or cables have to be guided inside or outside the clean room plenum.

Alternatively or in addition, the at least one clean room side wall element may also have at least one air outlet, for example in the form of a perforated plate. In particular, the air outlet, in a connected state of the at least one clean room side wall element and the ceiling module, is arranged at the end of the at least one clean room side wall element that is remote from the ceiling module. In this respect, the air outlet is arranged close to the floor when the clean room side wall element is mounted as intended. This makes it possible to recirculate exhaust air on the floor side.

Alternatively or in addition, the at least one clean room side wall element can also have at least one feedthrough means for feeding, in an airtight and particle-tight manner, supply lines, e.g. water lines and/or gas lines and/or power lines, through the clean room side wall element.

Alternatively or in addition, the at least one clean room side wall element may also have a fire protection layer, preferably in the form of a protective layer consisting of fire-retardant materials and integrated in the clean room side wall element.

Depending on the requirements, the clean room side wall elements can be equipped with one or more of the aforementioned functional units. This makes it possible to individually adapt a clean room cell to different requirements—using the same ceiling module. It is also conceivable to provide a set of standard clean room side wall elements (for example a clean room side wall element with a door, a clean room side wall element with a window, etc.), which can then be modularly assembled to form clean room cells according to requirements. Such a modular construction of standard components is particularly time- and cost-effective.

In another preferred embodiment, the system consisting of a ceiling module and at least one clean room side wall element may also comprise at least one clean room partition wall element that is or can be connected to the ceiling module, in particular to a ceiling support of the ceiling module. The at least one clean room partition wall element may be designed analogously to the clean room side wall element and can optionally have one or more of the functional units described above with respect to the clean room side wall element (door, window, air outlet, feedthrough means, fire protection layer, etc.).

As already explained above, such a clean room partition wall element allows a flexible subdivision of the clean room plenum which is delimited below the ceiling module. Sections can thus be flexibly defined, for example in order to meet different requirements for working regions in the clean room environment. There are additional configuration options in this respect, which allows yet further individualization of the clean room cell.

The above-described modular construction of a clean room cell consisting of a ceiling module, clean room side wall elements (with optional functional units) and clean room partition wall elements (with optional functional units) makes it possible to modularly construct complex clean room facilities consisting of a plurality of clean room cells. It is in particular possible to provide a set of a limited number of standard clean room cells which can then be modularly assembled to form complex, individual clean room facilities (consisting of a plurality of clean room cells). Such a modular clean room facility can then be constructed quickly. In addition, a clean room facility constructed from standard clean room cells is relatively inexpensive. Furthermore, such an embodiment makes it possible to modularly expand existing clean room facilities in a simple manner.

Another advantage of the described modular construction is that a considerable number of the work steps required for clean room construction can be carried out in a controlled working environment, and therefore fewer work steps are required at the construction site. This reduces the risk of accidents.

The invention will be explained in more detail in the following with reference to the drawings, in which.

Figure 11:
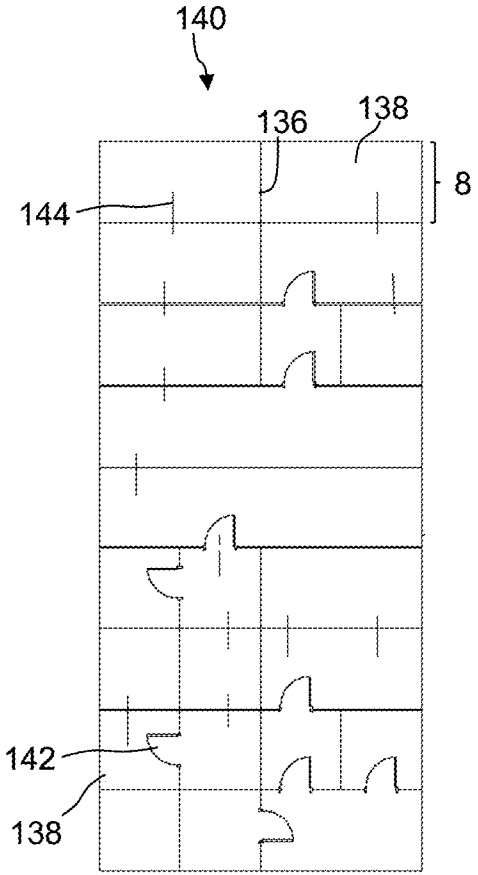
Figure 10:
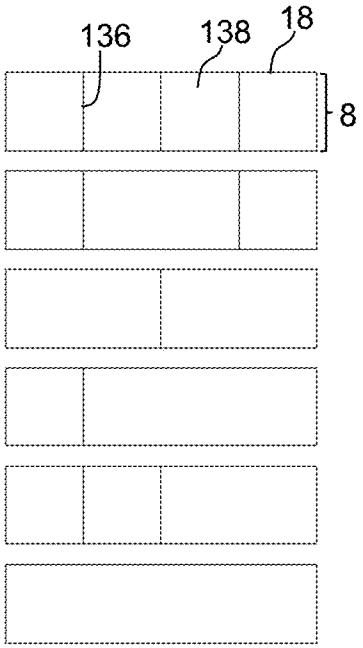

FIG. 10 schematically shows clean room cells with differently configured clean room partition wall elements in a plan view; and FIG. 11 schematically shows an exemplary embodiment of a clean room facility constructed from clean room cells in a plan view.

In the following description and in the drawings, the same reference signs are used in each case for identical or corresponding features.

Figure 1:
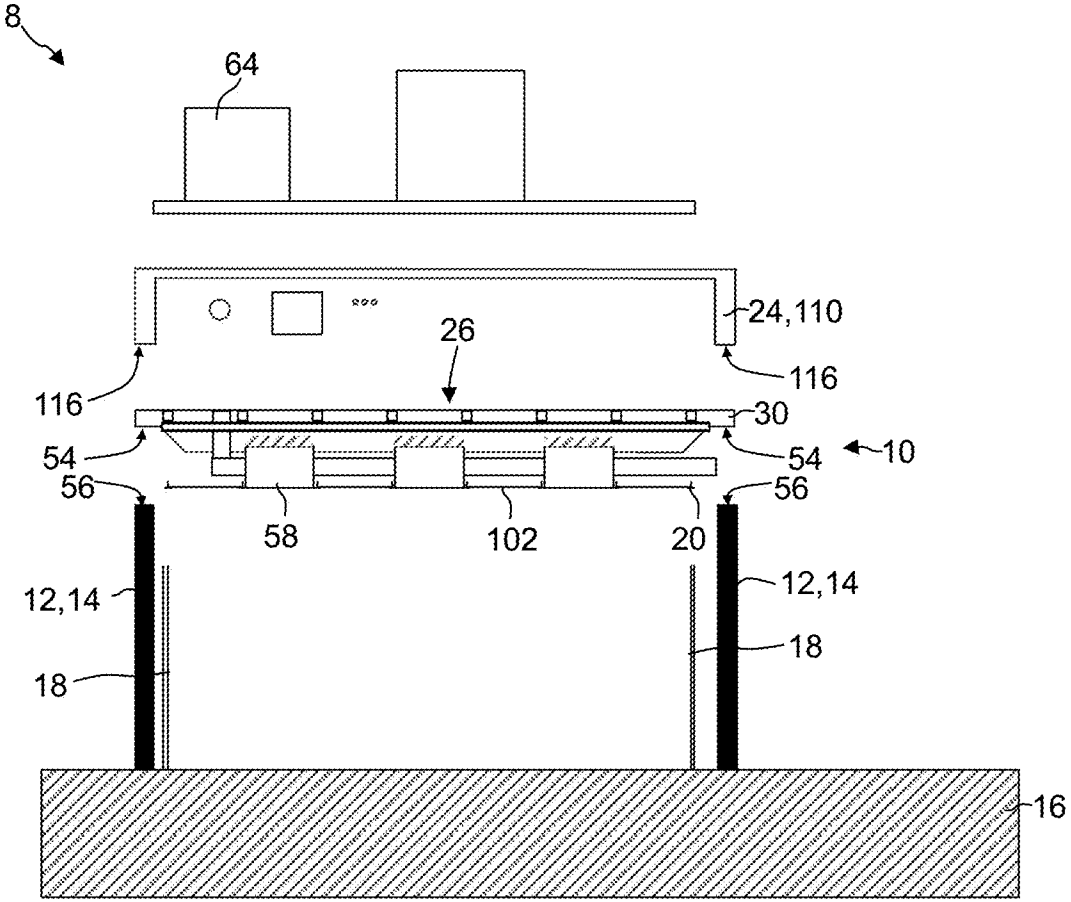
FIG. 1 is an outline of a system for the construction of a clean room cell in a side view.

FIG. 1 outlines a system for constructing a clean room cell designated as a whole by reference sign 8. Such a clean room cell 8 is shown in FIG. 2 in a fully assembled state.

Figure 2:
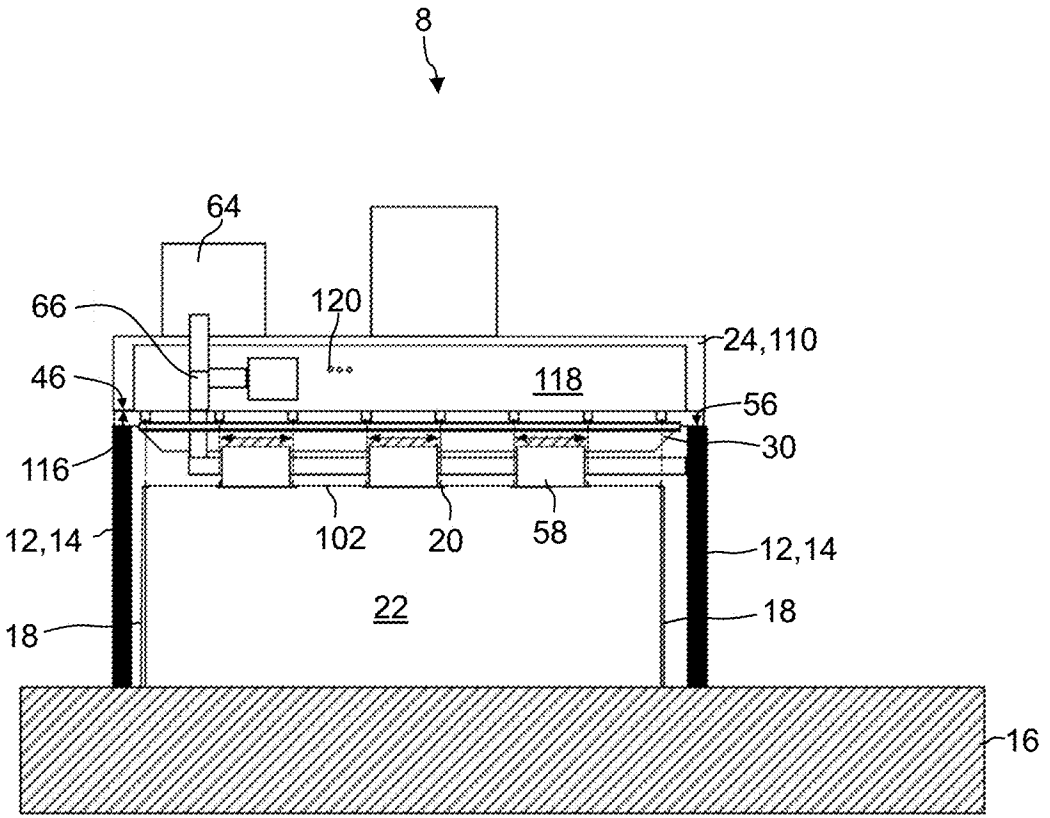
FIG. 2 is an outline of a clean room cell in an installed state in a side view.

The system comprises a ceiling module 10 which, in an installed state shown in FIG. 2, is arranged on a support structure 12 and connected thereto. The support structure 12 is formed in the present example by pillars 14 (for example steel beams) which are arranged, in particular vertically, on a foundation 16. The foundation 16 may be a building floor.

The system further comprises a plurality of clean room side wall elements 18 which, in the assembled state of the clean room cell 8, cooperate with a ceiling support 20 of the ceiling module 10 and define therewith a clean room plenum 22, i.e. the actual clean room area of the clean room cell 8 (cf. FIG. 2).

The system further comprises a holder 24 which, in an assembled state of the clean room cell 8, is arranged on an upper side 26 of the ceiling module 10. The holder 24, as described in more detail below, is formed by a transport frame 110 which is used to hold the ceiling module 10 during transport.

In embodiments not shown, the system may further comprise a clean room floor element, for example a clean room floor covering arranged on a building floor. These clean room floor elements are preferably adapted in terms of area to the ceiling module. In particular, the clean room floor elements are also designed as a modular structure, comprising a support frame and at least one cover layer fastened thereto. In particular, the cover layer comprises, as the uppermost layer, a floor covering which is adapted to the intended use of the clean room.

In the following, the ceiling module 10 will first be described in detail with reference to FIGS. 3 to 5.

The ceiling module 10 comprises a module support 30 for arrangement on and connection to the support structure 12. The ceiling module 10 further comprises the ceiling support 20 already mentioned above. When the ceiling module 10 is mounted as intended, the ceiling support is arranged below the module support 30 and is spaced apart therefrom. As a result, a technical space 32 is formed between the ceiling support 20 and the module support 30 (cf. FIG. 3). In the technical space 32, a technical device 34 is arranged which comprises clean room technology described in more detail below. The ceiling module 10 itself is therefore modularly constructed from the module support 30, the ceiling support 20 and the technical device 34 arranged between the module support 30 and the ceiling support 20. These units are preassembled to form the ceiling module 10.

Figure 5:
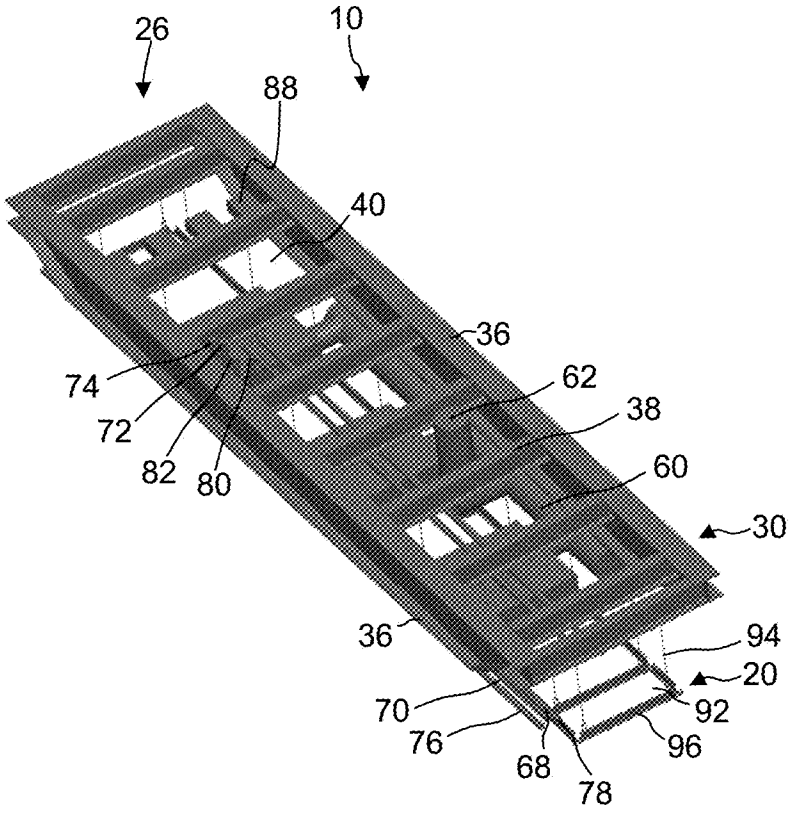
FIG. 5 is an outline of the ceiling module according to FIG. 3 in a second perspective view.

In the present example, the module support 30 has a rectangular basic shape overall and is formed by two mutually parallel and mutually spaced longitudinal supports 36 which are interconnected by a plurality of transverse supports 38 (cf. FIG. 5). The transverse supports 38, viewed in the longitudinal direction of the module support 30, are arranged at regular intervals, such that free spaces 40 are formed between the transverse supports 38 which allow access to the technical space 32 from the upper side 26 of the ceiling module 10.

By way of example and preferably, the longitudinal supports 36 and the transverse supports 38 are designed as double-T supports (cf. FIG. 5).

The two longitudinal supports 36 are identical in the present example. Each longitudinal support 36 has a central region 42 and two end regions 44 (cf. FIG. 4). In these regions, an upper side 46 of the longitudinal support 36 and an underside 48 of the longitudinal support 36 extend in parallel with one another. In the end regions 44, the longitudinal support 36 has a smaller thickness (highlighted in FIG. 4 by the double arrow designated by reference sign 50), i.e. a smaller distance between the upper side 46 and underside 48 of the longitudinal support 36, the thickness reducing linearly in a relevant transition region 52 between the central region 42 and the relevant end region 44 (cf. FIG. 4).

The underside 48 of the longitudinal supports 36—in the present example, a relevant lower flange of the longitudinal support 36 designed as a double-T support—forms abutment portions 54 in the respective end regions 44. In an installed state of the ceiling module 10, these abutment portions 54 then rest on corresponding bearing portions 56 of the support structure 12 (cf. FIG. 2).

The technical device 34 of the ceiling module 10 comprises three filter units 58 in the example shown. This embodiment is not mandatory and can be adapted to the particular application. The filter units 58 are designed as modular units each with their own module housing 59, the relevant module housing 59 being completely accommodated in the technical space 32 between the module support 30 and the ceiling support 20 (cf. FIGS. 3 and 4). The filter units 58 are interconnected via a common fluid line 60 (cf. FIGS. 3 and 5) in order to conduct supply and/or return air. The fluid line 60 has an air connection 62 which opens into the upper side 26 of the ceiling module 10. In a fully mounted state of the ceiling module 10 on the support structure 12, the air connection 62 can then be connected to an HVAC unit 64 via a connection line 66 (cf. FIG. 2).

The technical device 34 further comprises a fluid supply line 68 for feeding in cooling water and a fluid supply line 70 for returning cooling water. In the present example, the supply lines 68, 70 extend substantially in parallel with a longitudinal extent of the ceiling module 10 (cf. FIG. 4). The fluidic supply lines 68, 70 each have a fluid connection 72, 74 for connecting to an external cooling water supply. As can be seen from FIG. 5, the fluid connections 72, 74 likewise open, by way of example and preferably, into an upper side 26 of the ceiling module 10.

In the present example, the technical device 34 further comprises a fluidic supply line 76 for conducting supply air for clean room devices (not shown) arranged in the clean room plenum 22, and a corresponding fluidic supply line 78 for conducting exhaust air. The fluidic supply line 76 for conducting supply air and the fluidic supply line 78 for conducting exhaust air each have a fluid connection 80, 82. As can be seen from FIG. 5, the connections 80, 82 likewise open into the upper side 26 of the ceiling module 10.

In addition, the technical device 34 comprises a plurality of electrical supply lines 84 which are used in particular for supplying power to the filter units 58 and for supplying power to clean room devices (not shown) arranged in the clean room plenum 22. The electrical supply lines 84 are preferably arranged in one or more cable ducts 86 (cf. FIG. 3). A cable connection 90 is provided such that the electrical supply lines 84 open into an electrical connection box 88. The connection box 88 is arranged such that it is accessible from the upper side 26 of the ceiling module 10. By way of example, the electrical connection box 88 is arranged in the region of a free space 40 between two transverse supports 38 of the module support 30 (cf. FIG. 3). For the sake of clarity, the electrical supply lines 84 and the connections box 88 are not shown in some figures.

The ceiling support 20 is formed in the present example as a space frame which delimits a plurality of frame openings 92. As can be seen from FIGS. 4 and 5, the ceiling support 20 is suspended from the module support 30 via support anchors 94 (in particular by threaded rods).

The ceiling support 20 is, by way of example and preferably, formed by mutually perpendicular frame rails 96 which are interconnected at node points 98 via corresponding connecting elements 100. Preferably, the frame rails 96 are formed as aluminum profile rails.

Figure 3:
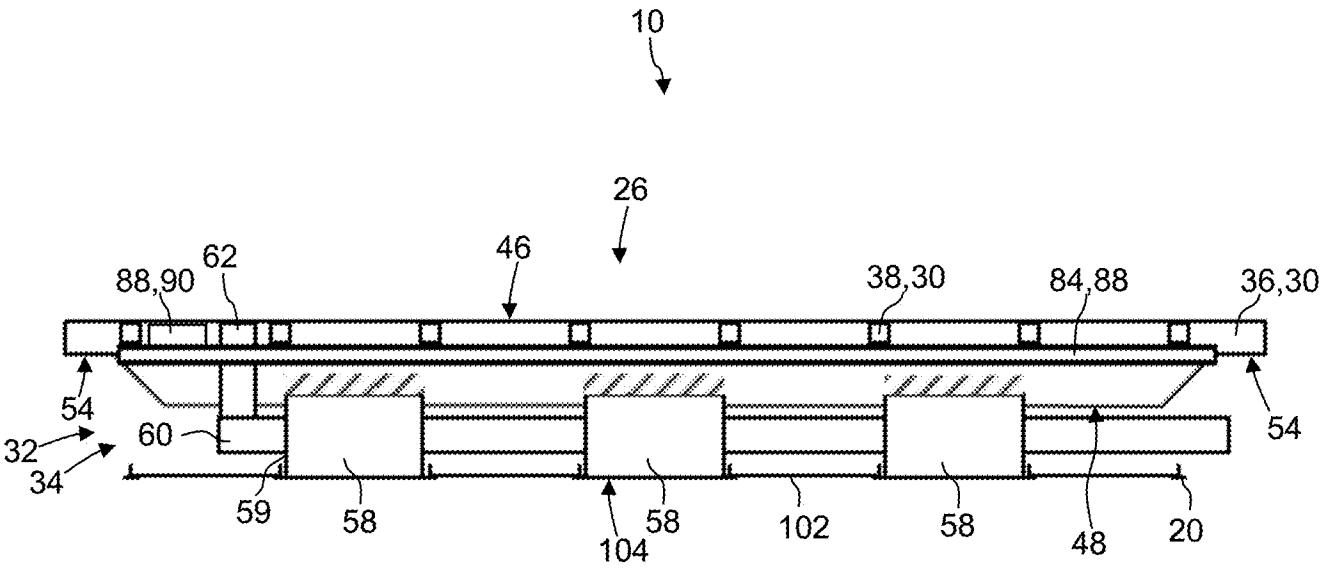
FIG. 3 is an outline of a ceiling module of the clean room cell according to FIG. 2 in a side view.
Figure 4:
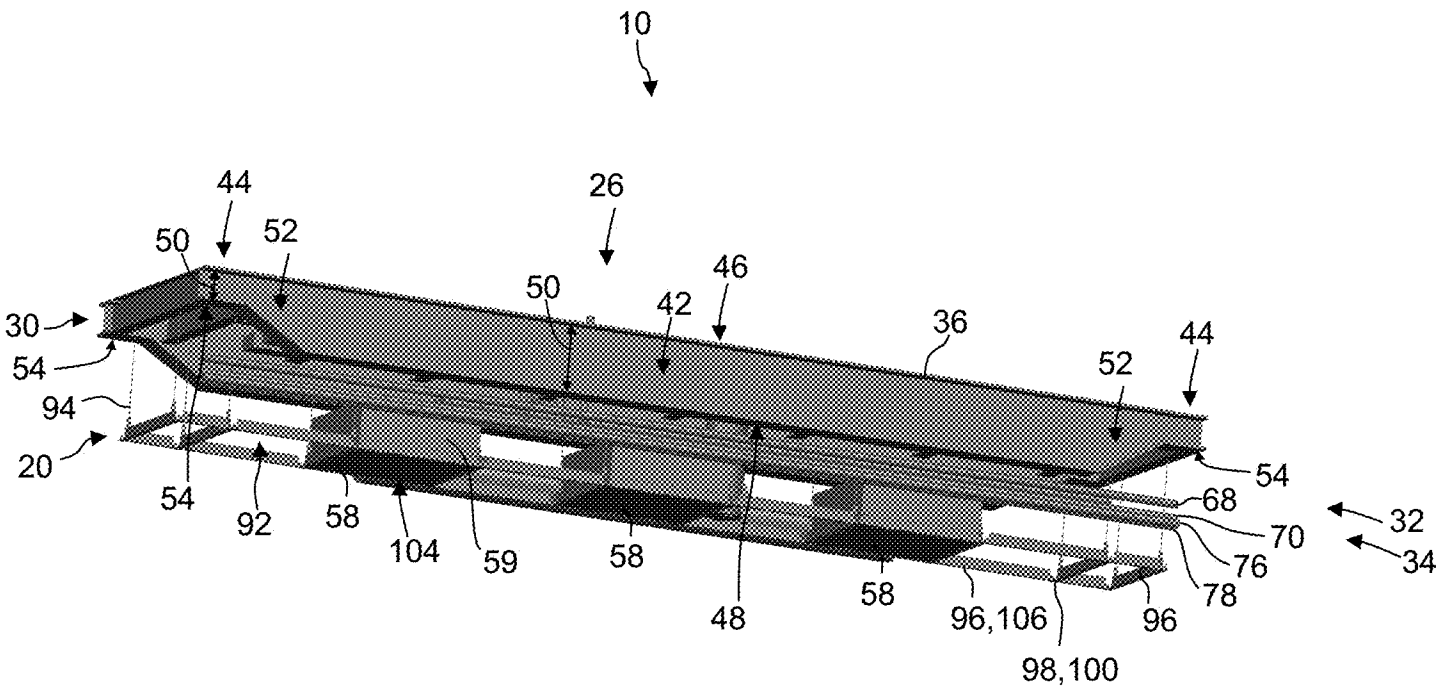
FIG. 4 is an outline of the ceiling module according to FIG. 3 in a first perspective view.

The frame openings 92 are used in each case for arranging a filter unit 58 or a clean room ceiling panel 102 (cf. FIG. 3). Depending on requirements, one or more frame openings 92 may be occupied by a filter unit 58. The remaining ones, that is to say the frame openings 92 not occupied by filter units 58, are then provided with clean room ceiling panels 102.

In the present example, three frame openings 92 are occupied by filter units 58, a frame opening 92 occupied by a clean room ceiling panel 102 being arranged between each of the frame openings 92 occupied by filter units 58 (cf. FIG. 3). The clean room ceiling panels 102 and the filter units 58 are connected to the ceiling support 20 in an airtight and particle-tight manner and held thereon.

The ceiling support 20, together with the clean room ceiling panels 102 and the filter units 58—more precisely, respective air outlets 104 of the filter units 58—forms the clean room ceiling. In FIGS. 4 and 5, the clean room ceiling panels 102 are removed for a better view.

The ceiling support 20 also has connecting portions 106 which are designed for airtight and particle-tight connection of the ceiling support 20 to clean room side wall elements 18. In the present example, the connecting portions 106 are designed as connecting rails which are integrated in the outer frame rails 96 of the ceiling support 20, i.e. in those frame rails 96 which define a periphery of the ceiling support 20.

To construct the clean room cell 8, the ceiling module 10 is arranged on the support structure 12 such that the abutment portions 54 of the module support come into abutment with the bearing portions 56 of the support structure 12. In addition, the clean room side wall elements 18 are connected to the ceiling support 20 via the connecting portions 106 such that the clean room plenum 22 is formed.

Figure 6:
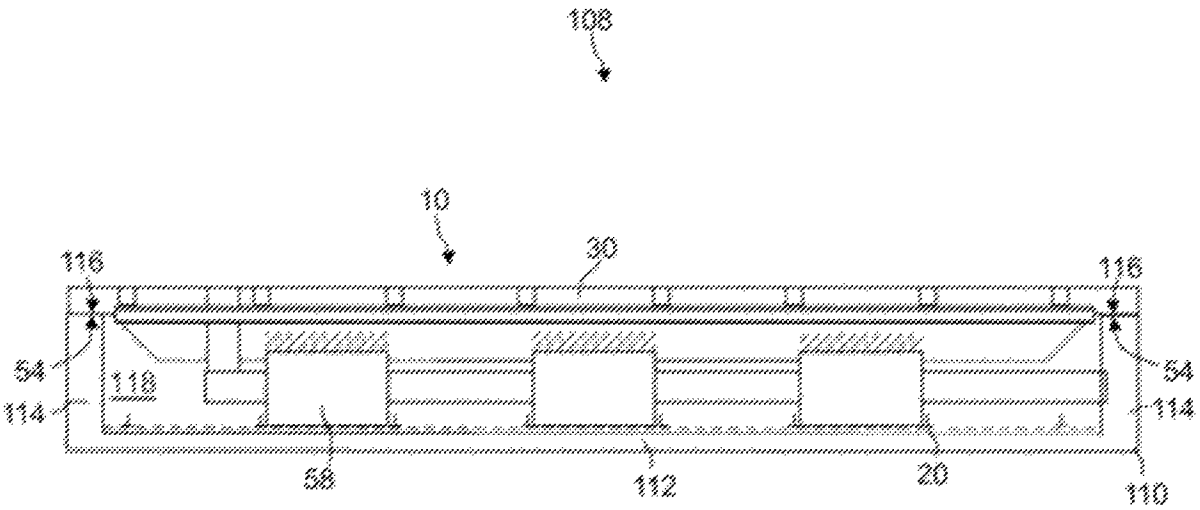
FIG. 6 is an outline of a system comprising a ceiling module according to FIG. 3 and a transport frame in a side view.

FIG. 6 shows a system 108 which comprises a ceiling module 10 as explained above and a transport frame 110. The transport frame 110 is used to hold the ceiling module 10 during transport.

The transport frame 110 is substantially U-shaped with one long limb 112 and two short limbs 114. The long limb 112 extends at the bottom, in particular horizontally, in a transport state shown in FIG. 6. The two short limbs 114 then extend substantially vertically. The free ends of the short limbs 114 of the transport frame 110 form abutment portions 116 for abutting the abutment portions 54 on the underside 48 of the module support 30—which cooperate, in an installed state of the ceiling module 10, with the bearing portions 56 on the support structure (see above).

As can be seen from FIG. 6, the technical device 34 and the ceiling support 20 of the ceiling module 10 are arranged, in the transport state, in a transport space 118 formed between the short limbs 114 of the transport frame 110.

In an installed state of the ceiling module 10—i.e. when the ceiling module 10 is removed from the transport frame 110 and is connected to the support structure 12—the transport frame 110, as already explained above, can be arranged on the upper side 26 of the ceiling module 10. The abutment portions 116 of the transport frame 110 then abut the upper side 46 of the module support 30 (cf. FIG. 2). The transport frame 110, as already explained, then forms a holder 24, in particular for the HVAC unit 64. The transport space 118 then serves as a distribution space in which distribution lines 120, for example distribution lines for connecting the supply lines 68, 70, 76, 78, 84 to corresponding supply lines of adjacent ceiling modules 10, can be arranged (cf. FIG. 2).

Figure 7:
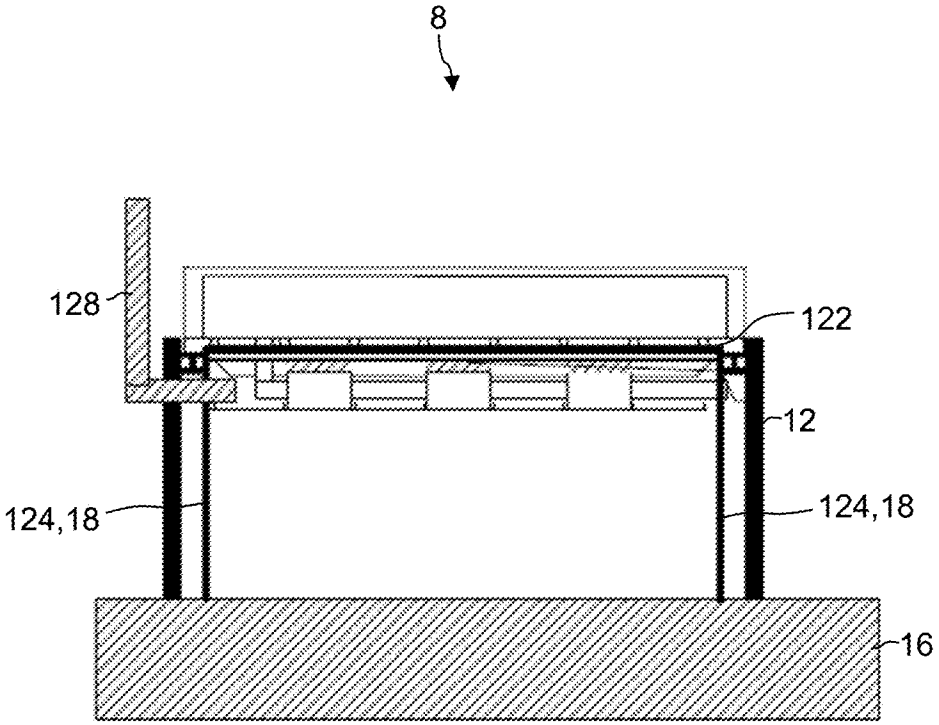
FIG. 7 is an outline of the clean room cell according to FIG. 2 with a fire protection means in a first embodiment in a side view.
Figure 8:
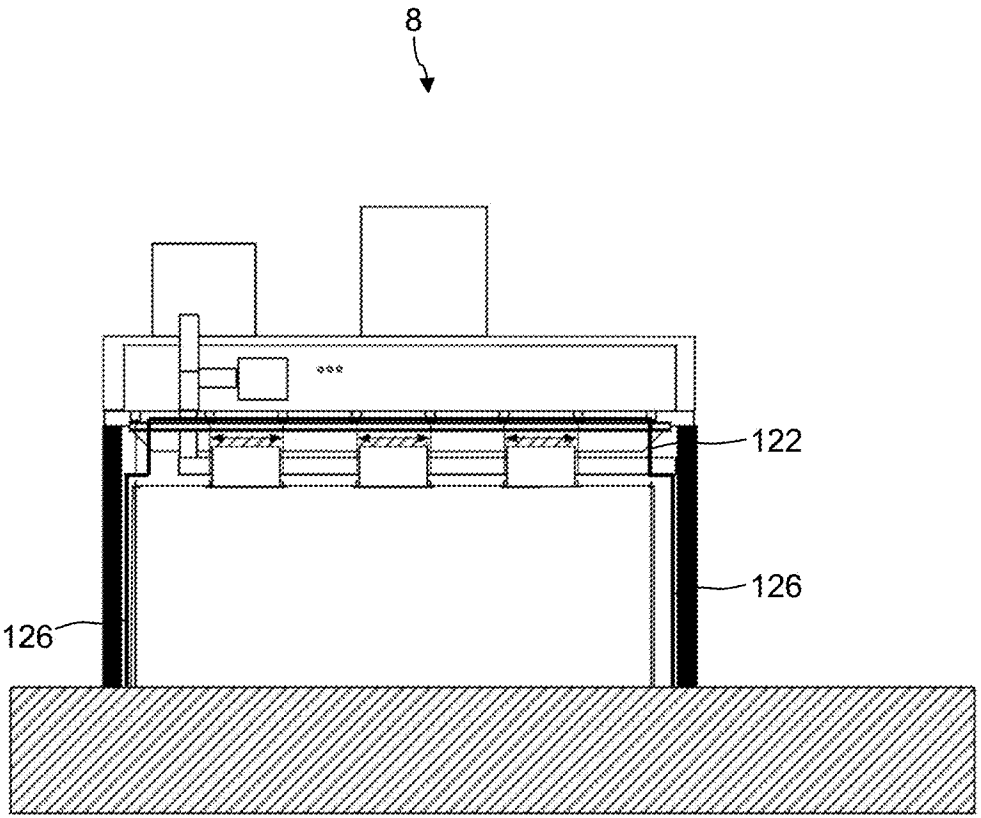
FIG. 8 is an outline of the clean room cell according to FIG. 2 with a fire protection means in a second embodiment in a side view.

In an embodiment shown in FIGS. 7 and 8, the clean room cell 8 can also have a fire protection means. For this purpose, the ceiling module 10 can be provided with a fire protection layer 122 which, in a first embodiment shown in FIG. 7, can be connected to a fire protection layer 124 of a relevant clean room side wall element 18 in order to form a fire protection layer that encloses the clean room plenum 22. In an alternative embodiment shown in FIG. 8, the fire protection layer 122 of the ceiling module 10 can be designed to be connected to a fire protection layer 126 on the support structure side. Optionally, the clean room cell 8 can also have a smoke extraction unit 128 (cf. FIG. 7).

Figure 9:
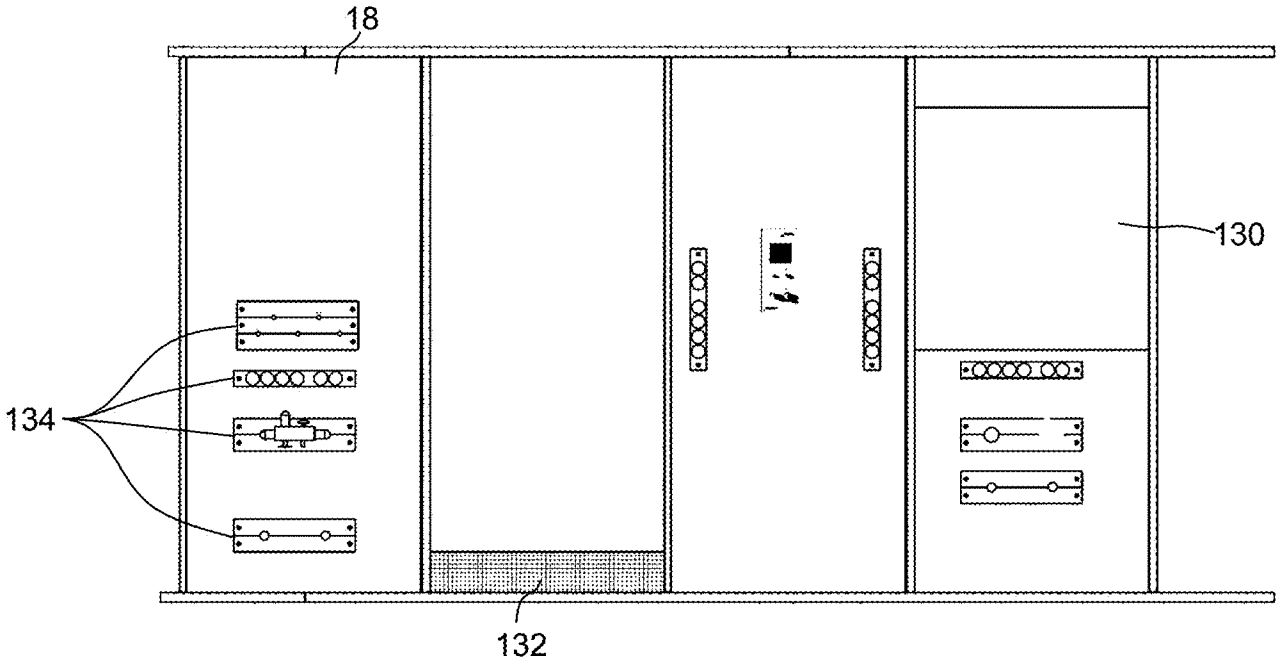
FIG. 9 is an outline of a plurality of clean room side wall elements with different functional units in a side view.

FIG. 9 shows, by way of example, various embodiments of clean room side wall elements 18 which have different functional units. For example, a clean room side element 18 can have a window 130. Furthermore, it is possible for a clean room side wall element 18 to have an air outlet 132 for exhaust air, by way of example and preferably in the form of a perforated plate, which is arranged at a floor-side end of the clean room side wall element 18. In addition, feed-through means 134 may be provided for feeding, in an airtight and particle-tight manner, supply lines (for example water lines, gas lines, cables, etc.) through the clean room side wall element 18. In embodiments not shown, a clean room side wall element 18 can also have an integrated fluid duct for exhaust air and/or at least one integrated cable duct for electrical cables or network cables, etc. In further embodiments, the clean room side element 18 can have a door. The clean room side wall elements 18 may each have one or more of the above-mentioned functional units.

In a further embodiment, clean room partition wall elements 136 may be provided which are designed to subdivide a clean room plenum 22 defined by the clean room side wall elements 18 into sections 138 (cf. FIG. 10). The clean room partition wall elements 136 may be formed analogously to the clean room side wall elements 18 and may optionally also have functional units described above with respect to the clean room side wall elements 18.

FIG. 10 shows, by way of example, various configuration possibilities of a clean room cell 8, which result from a varying number and arrangement of clean room partition wall elements 136. The exemplary clean room cells 8 shown in FIG. 10 constitute a set of standard clean room cells which can be modularly assembled to form complex clean room facilities.

As can be seen from FIG. 10, the clean room partition wall elements 136 are arranged in particular orthogonally to a longitudinal extent of the ceiling module 10. In order to connect a clean room intermediate wall element 136 to the ceiling support 20, the ceiling support 20 can have connecting portions (not shown) which are preferably formed analogously to the connecting portions for connecting the ceiling support 20 to the clean room side wall elements 18, but in particular are integrated in the inner frame rails 96 extending transversely to a longitudinal extent of the ceiling support 20.

FIG. 11 shows an example of a clean room facility 140 which is modularly constructed from a plurality of clean room cells 8 arranged beside one another—more precisely from the standard clean room cells shown in FIG. 10. As can be seen from FIG. 11, different configurations of the clean room side wall elements 18 and the clean room partition wall elements 136 also make it possible to form complex clean room structures. For example, in the clean room facility 140 shown in FIG. 11, individual clean room side wall elements 18 and clean room partition wall elements 136 are fitted with doors 142 to allow the passage from one section 138 of a clean room cell 8 to another section 138 of the clean room cell 8 or to a section 138 of an adjacent clean room cell 8. Furthermore, individual sections 138 are connected to form common sections (indicated in FIG. 11 by the vertical lines designated by reference sign 144).

The invention claimed is:

1. A Ceiling module for the construction of a clean room cell, the Ceiling module comprising:

a module support for arrangement on and connection to a support structure;

a technical device including at least one filter unit; and a ceiling support which is spaced apart from the module support such that a technical space is formed between the ceiling support and the module support, wherein the module support, the ceiling support and the technical device are connected to form a unit, the technical device is arranged inside the technical space, the ceiling support is formed by mutually perpendicular frame rails, outer frame rails are provided which define a periphery of the ceiling support and inner frame rails are provided which are perpendicular to a longitudinal extent of the ceiling support, the ceiling support has connecting portions which are designed for connection of the ceiling support to clean room side wall elements and the ceiling support has connecting portions which are designed for connection of the ceiling support to clean room partition wall elements, the connecting portions for connecting the ceiling support to the clean room side wall elements are arranged on the outer frame rails and the connecting portions for connecting the ceiling support to clean room partition wall elements are arranged on the inner frame rails, and the frame rails comprise the outer frame rails and the inner frame rails.

2. The Ceiling module according to claim 1, wherein the at least one filter unit is designed as a modular unit with its own module housing, and the module housing is completely accommodated in the technical space between the module support and the ceiling support.

3. The Ceiling module according to claim 2, wherein the at least one filter unit includes at least one filter means for filtering air and an air conveying means for generating an airflow.

4. The Ceiling module according to claim 3, wherein the at least one filter unit is held on the ceiling support.

5. The Ceiling module according to claim 4, wherein the technical device further includes:

at least one fluid line for conducting supply air and/or return air for the at least one filter unit, the at least one fluid line having at least one air connection;

at least one fluidic supply line having at least one fluid connection; and at least one electrical supply line having at least one cable connection.

6. The Ceiling module according to claim 5, wherein the at least one air connection, the at least one fluid connection and the at least one cable connection form a plurality of connections, and the at least one air connection, the at least one fluid connection and the at least one cable connection are arranged such that a first connection of the plurality of connections is accessible from an upper side of the ceiling module.

7. The Ceiling module according to claim 6, wherein the ceiling support is designed as a frame which delimits a plurality of frame openings, and the frame openings are each designed for arranging the at least one filter unit or a clean room ceiling panel.

8. The Ceiling module according to claim 7, wherein a subset of the frame openings is occupied by the at least one filter units and the remaining frame openings are occupied by clean room ceiling panels.

9. The Ceiling module according to claim 7, wherein a first filter unit of said at least one filter unit and/or a first clean room ceiling panel are connected to the ceiling support in an airtight and particle-tight manner.

10. The Ceiling module according to claim 1, wherein the module support is rectangular and has two longitudinal supports and a plurality of transverse supports.

11. The Ceiling module according to claim 10, wherein each longitudinal support has a central region and two end regions, the longitudinal support has a smaller thickness in the end regions than in the central region, and an underside of the longitudinal support forms abutment portions in the respective end regions for abutting a support structure.

12. A System comprising the Ceiling module according to claim 1 and at least one clean room side wall element that is or can be connected to the Ceiling module.

13. The System according to claim 12, wherein the at least one clean room side wall element has at least one of the following:

a. the at least one clean room side wall element has a door;

b. the at least one clean room side wall element has at least one window;

c. the at least one clean room side wall element has at least one integrated fluid duct for exhaust air and/or at least one integrated cable duct for electrical cables;

d. the at least one clean room side wall element has at least one air outlet which, in a connected state of the at least one clean room side wall element and the ceiling module, is arranged at the end of the at least one clean room side wall element that is remote from the Ceiling module;

e. the at least one clean room side wall element has at least one feedthrough means for feeding, in an airtight and particle-tight manner, supply lines through the clean room side wall element; and/or f. the at least one clean room side wall element has a fire protection layer.

14. The System according to claim 13, wherein at least one clean room partition wall element is provided which is or can be connected to the ceiling support of the Ceiling module.

15. The System according to claim 13, wherein at least one clean room partition wall element is provided which is capable of connecting to the ceiling support of the Ceiling module.

16. A System comprising a transport frame and a Ceiling module for the construction of a clean room cell, the Ceiling module comprising:

a module support for arrangement on and connection to a support structure;

a technical device including at least one filter unit; and a ceiling support which is spaced apart from the module support such that a technical space is formed between the ceiling support and the module support, wherein the module support, the ceiling support and the technical device are connected to form a unit, and the technical device is arranged inside the technical space, wherein the transport frame and the Ceiling module are designed such that the Ceiling module can be held in the transport frame for transport, and the transport frame has abutment portions which are designed to abut an underside of the module support of the Ceiling module in a transport state of the Ceiling module and to abut an upper side of the module support of the Ceiling module in an installed state of the Ceiling module.

17. The System according to claim 16, wherein the transport frame is substantially U-shaped with one long limb and two short limbs, and free ends of the short limbs form the abutment portions for abutting the module support of the Ceiling module.

* * * * *